US005361434A

United States Patent [19]

Hagemeister et al.

[11] Patent Number: 5,361,434

[45] Date of Patent: * Nov. 8, 1994

[54] STACKABLE BEDDING FOUNDATION

[75] Inventors: Robert C. Hagemeister, Boston, Mass.; Steven E. Ogle; Thomas J. Wells, both of Carthage, Mo.

[73] Assignee: Leggett & Platt, Incorporated, Carthage, Mo.

[ * ] Notice: The portion of the term of this patent subsequent to Oct. 1, 2008 has been disclaimed.

[21] Appl. No.: 988,030

[22] Filed: Dec. 9, 1992

Related U.S. Application Data

[63] Continuation of Ser. No. 880,289, May 4, 1992, abandoned, which is a continuation of Ser. No. 767,246, Sep. 27, 1991, abandoned, which is a continuation-in-part of Ser. No. 629,160, Dec. 18, 1990, Pat. No. 5,052,064.

[51] Int. Cl.[5] ..... A47C 23/053

[52] U.S. Cl. ..... 5/247; 5/255; 5/264.1; 5/266; 5/276

[58] Field of Search ..... 5/247, 255, 260, 264.1, 5/265, 266, 270; 267/95, 103-107

[56] References Cited

U.S. PATENT DOCUMENTS

| | | | |
|---|---|---|---|
| 2,415,765 | 5/1943 | Schmidt . | |
| 3,725,965 | 4/1973 | Smith et al. | 5/247 X |
| 3,990,121 | 4/1976 | Whitaker | 5/260 |
| 4,000,531 | 1/1977 | Inman | 5/260 X |
| 4,012,802 | 3/1977 | Hutchinson et al. | 5/247 |
| 4,069,525 | 1/1978 | Valoff | 5/255 X |
| 4,377,279 | 3/1983 | Schulz, Jr. et al. | 5/247 X |
| 4,739,977 | 4/1980 | Dabney | 267/103 |
| 4,771,995 | 4/1988 | Wells et al. | 5/247 X |
| 5,052,064 | 10/1991 | Hagemeister et al. | 5/247 X |
| 5,176,367 | 1/1993 | Rodgers et al. | 267/103 |
| 5,178,372 | 1/1993 | Rodgers et al. | 267/103 |

*Primary Examiner*—Michael F. Trettel
*Attorney, Agent, or Firm*—Wood, Herron & Evans

[57] ABSTRACT

A nestably stackable bedding foundation assembly which replaces the traditional border wire and disposed coil spring foundation assembly in a so-called box spring. The nestably stackable foundation assembly may be nestably stacked with numerous other such assemblies for transportation, thereby avoiding the need to compress and tie the assembly for shipping. A bedding foundation comprises a rectangular base, a nestably stackable bedding foundation assembly fixedly attached atop the base, and spring means disposed between and connected to the base and the nestably stackable assembly.

8 Claims, 6 Drawing Sheets

STACKABLE BEDDING FOUNDATION

This application is a continuation of 07/880,289, filed May 4, 1992, now abandoned, which is in turn a continuation of 07/767,246, filed Sep. 27, 1991, now abandoned, which is in turn a continuation-in-part of 07/629,160, filed Dec. 18, 1990, which is now U.S. Pat. No. 5,052,064.

BACKGROUND OF THE INVENTION

1. Field of the Invention

This invention relates generally to bedding, and more particularly to a nestably stackable bedding foundation.

2. Description of the Prior Art

Bedding foundations or so-called box spring assemblies generally comprise spaced border wires between which are disposed coil or bent wire spring modules. As thus manufactured, these box spring assemblies are bulky and shipping to the manufacturer for application of padding and covering thereto is costly because of space requirements. In order to reduce the space requirements, it is customary to compress the assemblies to reduce their individual thicknesses and, when compressed, to tie them in their compressed state. This involves providing presses and ties which are expensive, and the extra operations of pressing and tieing the assemblies. At the delivery end, the manufacturer must cut and discard the ties before applying the covering. These additional material and handling costs increase the end cost of box spring assemblies.

It has therefore been one object of the invention of this application to construct a bedding foundation assembly that can be stacked for shipping without having to compress and tie the assembly.

Another object of the present invention has been to provide a bedding foundation assembly which is relatively simple to manufacture, and which may substitute for a traditional box spring assembly having coil spring modules.

SUMMARY OF THE INVENTION

The present invention is a nestably stackable bedding foundation assembly for use in place of the traditional box spring assembly. This bedding foundation assembly comprises a rectangular border wire and transversely-spaced, parallel, and longitudinally-extending support wires parallel to the border wire sides and having ends connected to the border wire ends. These support wires are generally corrugatedly formed along their lengths, having peaks and valleys with the peaks being generally coplanar with the plane defined by the border wire and the valleys being displaced beneath and intermediate of the peaks. Longitudinally-spaced, parallel and transversely-extending upper connector wires, parallel to the border wire ends, are connected along their lengths to the peaks of the support wires. Longitudinally-spaced, parallel, and transversely-extending lower connector wires, parallel to the border wire ends, are connected to the valleys of the support wires. The longitudinal voids between the peaks of the support wires are of a greater dimension than the valleys of the support wires. This configuration enables one nestably stackable bedding foundation assembly to be nestedly stacked atop a second assembly since the support wire valleys of the first assembly may enter into the voids between the peaks of the support wires of the second assembly. Such a nestedly stacked arrangement results in a total height dimension which is less than the sum of the individual assembly height dimensions.

A bedding foundation incorporating the present invention comprises a rectangular base, a nestably stackable wire core assembly according to the present invention fixedly attached atop the base, and spring means disposed between and connected to the base and the nestably stackable assembly.

The primary advantage of the present invention is that it enables relatively inexpensive bedding foundation wire cores to be tightly compacted and shipped in a minimum of space to an assembly destination, thereby reducing the ultimate cost of the core to the assembler.

Another advantage of the present invention is that bedding foundation assemblies may be rapidly loaded by a manufacturer for transportation to the destination of assembly without the need for compressing and tieing the assemblies.

Yet another advantage of the present invention is that the need for costly presses and ties necessary to compress a conventional box spring assembly for transportation is obviated.

A further advantage of the present invention is that bedding foundation assemblies may be rapidly unloaded without the time consuming and labor intensive tasks of clipping and discarding the tie wires used to hold conventional box spring assemblies in a compressed state.

These and other objects and advantages of the present invention will more readily become apparent during the description of the drawings herein, in which:

DESCRIPTION OF THE PREFERRED EMBODIMENTS

Figure 1:
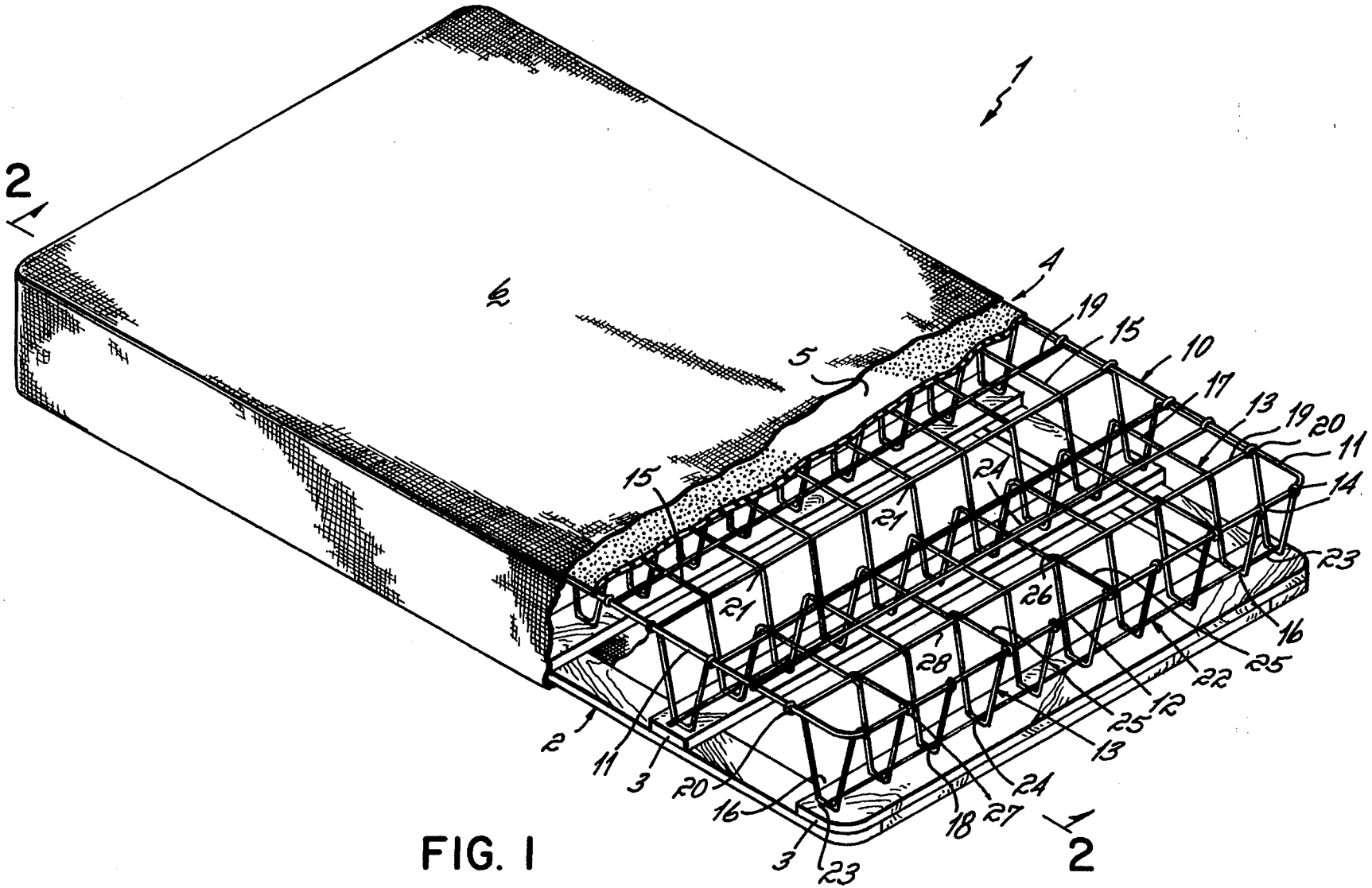
FIG. 1 is a perspective view, partially broken away, of a bedding foundation assembly embodying the invention of this application.

Referring first to FIG. 1, a bedding foundation 1 is illustrated. The foundation i has a rectangular wooden base frame 2 on which are attached transverse wooden slats 3. Atop these transverse slats 3 is the nestably stackable assembly or wire core 4, which is the invention of this application. A foam pad 5 overlies the nestably stackable assembly 4, and a fabric covering 6 overlies the foam pad 5 and surrounds the nestably stackable assembly 4 and the base frame 2.

Describing the nestably stackable assembly 4 now in more detail, it comprises a rectangular steel border wire 10 having two parallel sides 11, 11 and two parallel ends 12, 12, with the parallel sides 11, 11 being longer than the parallel ends 12, 12. Transversely-spaced, parallel, and longitudinally-extending steel support wires 13 are parallel to the border wire sides 11, 11 and have ends 14 which are crimped around the ends 12, 12 of the border wire 10. These support wires 13 are formed so as to be generally corrugatedly-shaped along their lengths, having peaks 15 and valleys 16. These peaks 15 and valleys 16 are flattened at their extrememost locations 17 and 18, respectively. These flattened peaks 17 are generally coplanar with the plane defined by the border wire 10, with the flattened valleys 18 being vertically spaced beneath and intermediate of the flattened peaks 17.

Longitudinally-spaced, parallel, and transversely-extending steel upper connector wires 19 extend parallel to the border wire ends 12, 12 and have ends 20 which are crimped around the border wire sides 11, 11. These upper connector wires 19 are welded intermediate of their ends along their lengths 21 to the flattened peaks 17 of the support wires 13. The upper connector wires form a generally planar top of the assembly 4.

The support wires 13 define a plurality of support wire means depending from and forming part of the upper connector wires, each support wire means of which tapers downwardly from the planar top to a lower end, the lower ends being located in a common base plane and being adapted to be secured to a foundation base 2.

Longitudinally-spaced, parallel, and transversely-extending steel lower connector wires 22 extend parallel to the border wire ends 12, 12 and are welded at their ends 23 and intermediate of their ends along their lengths 24 to the flattened valleys 16 of the support wires 13.

Figure 2:
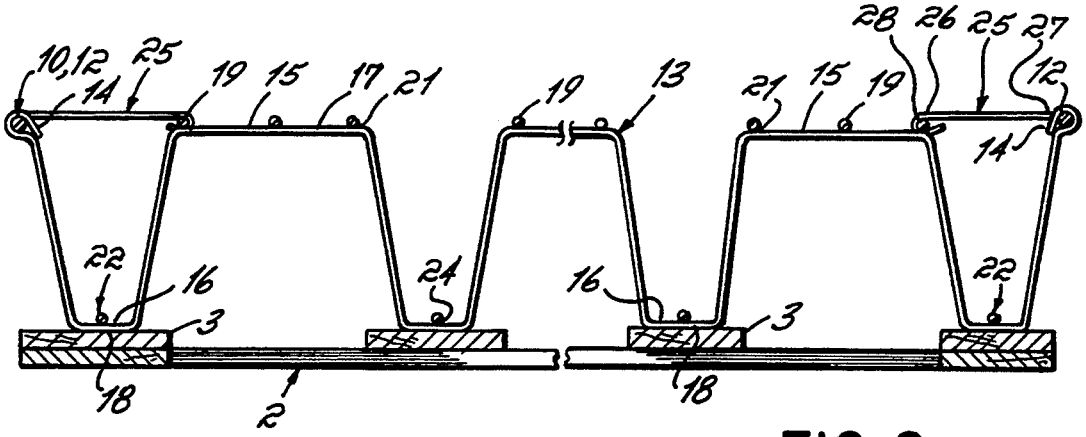
FIG. 2 is a view taken along lines 2—2 of FIG. 1 illustrating the corrugatedly formed support wires and optional end connection wires.

Referring now to FIG. 2, the support wires 13 have flattened peaks 17 and flattened valleys 18, with the support wire ends 14 being crimped around the border wire 10. In this embodiment, three upper connector wires 19 per flattened peak 17 are illustrated, along with one lower connector wire 21 per flattened valley 18. The flattened valleys 18 of the support wires 13 are stapled or otherwise attached to the transverse slats 3 which are in turn affixed to the base frame 2.

If desired, additional steel end wires 25 may be added either before or after the stackable assembly 4 has reached its final assembly destination. These end wires 25 have ends 26 and 27 which are crimped around the border wire 10 and the endmost upper connector wire 28, respectively. These end wires 25 provide additional stiffness to the stackable assembly 4 in an edgemost location of the ends of the assembly 4 so as to prevent the end border wires from deflecting and being permanently distorted when a person sits on the end of a bed of which the foundation forms a part.

The metal core portion of a bedding foundation is generally manufactured by a supplier, who then ships it to an assembler. The assembler adds to the metal core a wooden base 2, slats 3, padding 5, and upholstery 6 to make a completed product.

Figure 3:
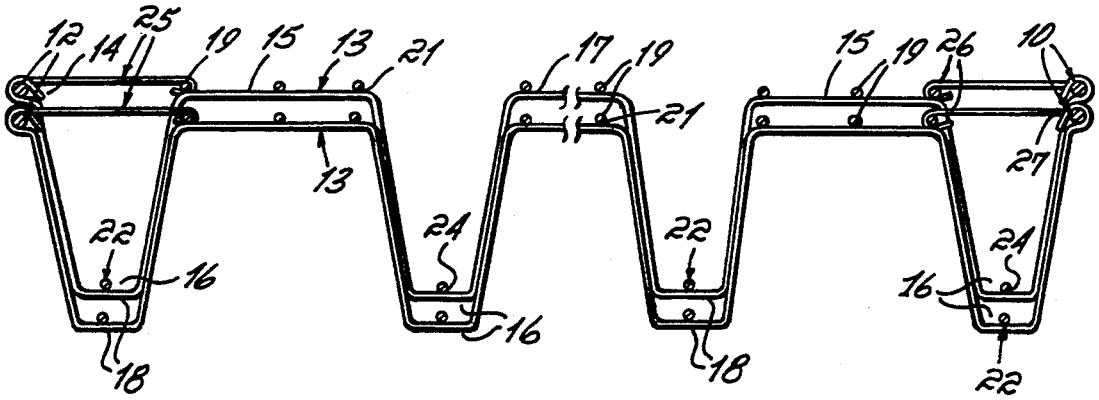
FIG. 3 is a view like FIG. 2 but illustrating two unmounted foundations stacked and nested one within the other for shipment.

The invention of this application facilitates shipment of the metal core or stackable assembly by a supplier to the assembler. With reference to FIG. 3, it will be seen that a first stackable assembly or core 4 may be placed upon a surface with the flattened valleys 18 of the support wires 13 oriented downwardly and the flattened peaks 17 of the support wires 13 oriented upwardly. Next, a second like assembly 4 is placed atop the first assembly 4, with its flattened support wire valleys 18 and flattened support wire peaks 17 likewise oriented downwardly and upwardly, respectively. The flattened valleys 18 of the second assembly 4 are thereby allowed to enter into the voids between the flattened peaks 17 of the first assembly 4. The second assembly 4 nestles downwardly within the first assembly 4 until the outside dimension of the valleys 16 of the second assembly 4 is equal to the inside dimension of the valleys 16 of the first assembly 4. At this point, the second assembly 4 comes to rest within the first assembly 4, with the overall heighth of the nested assemblies being substantially less than the sum of the individual heighths of the assemblies. Of course, any number of assemblies may be nested and stacked together for storage or shipment.

Figure 4:
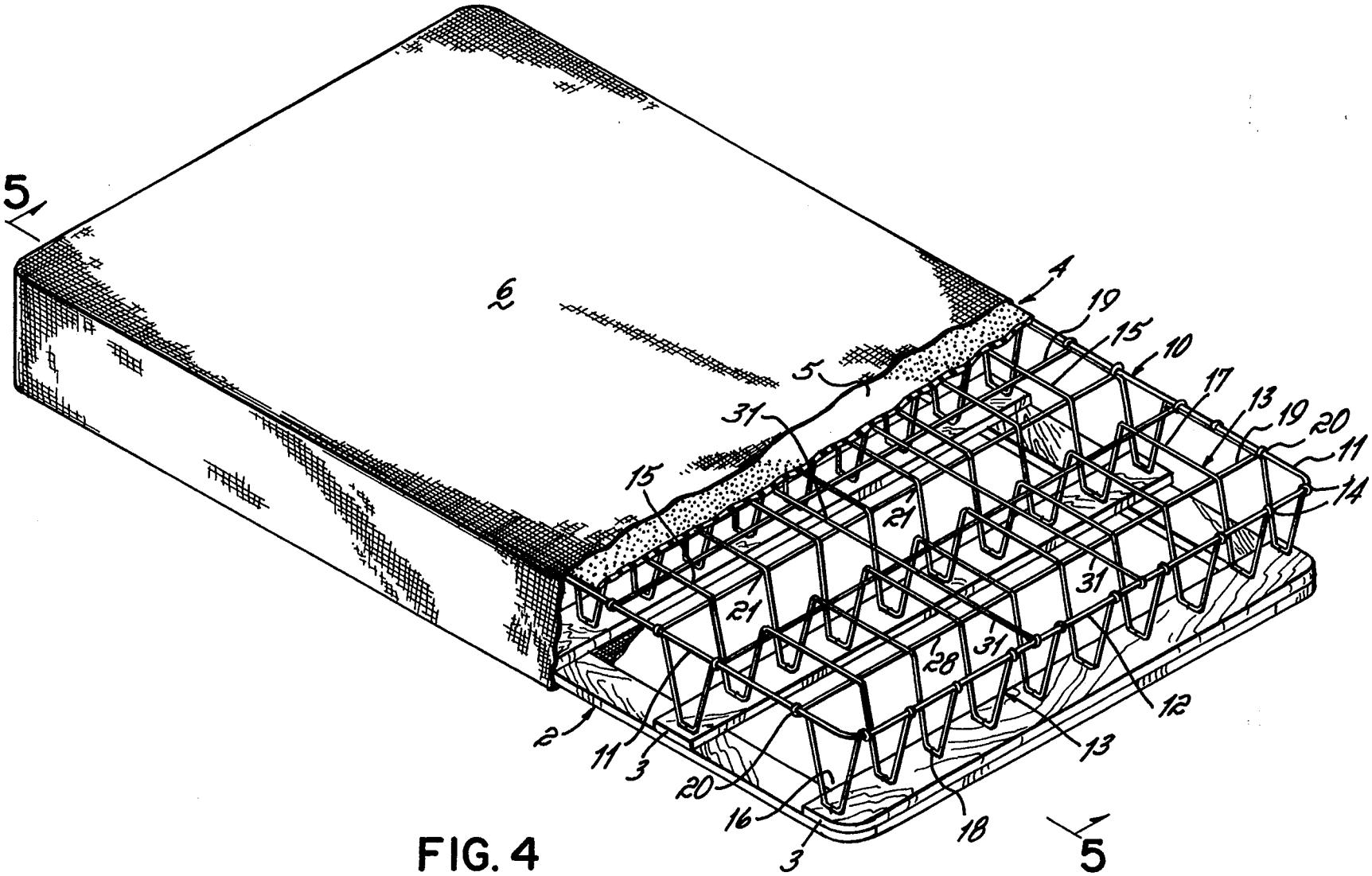
FIG. 4 is a perspective view, partially broken away, of a bedding foundation assembly embodying an alternative embodiment of the present invention.
Figure 5:
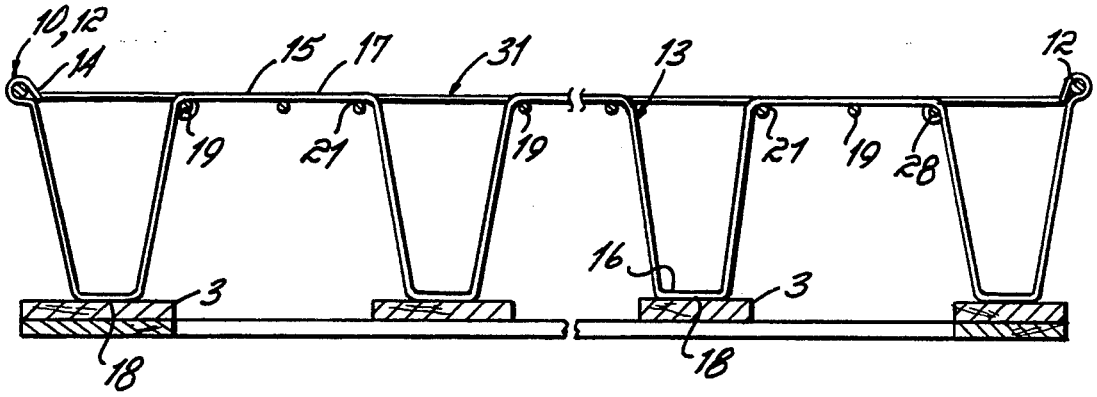
FIG. 5 is a view taken along line 5—5 of FIG. 4.
Figure 6:
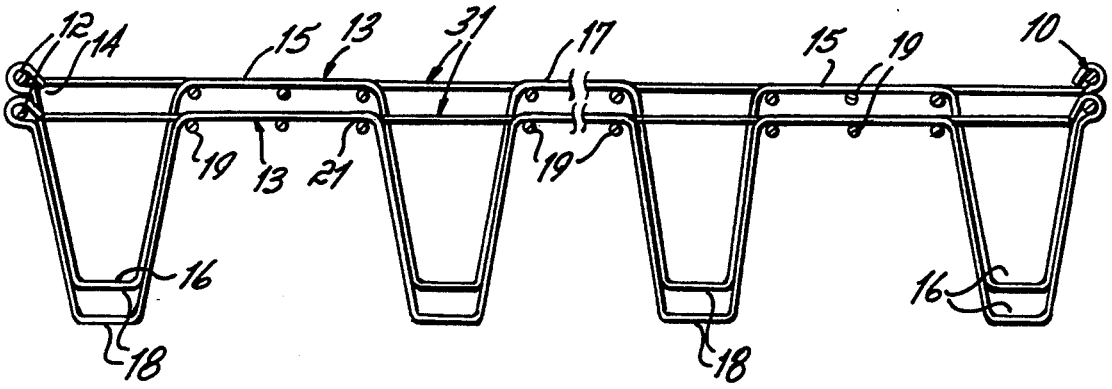
FIG. 6 is a view like FIG. 5 but illustrating the alternative embodiment foundations unmounted on base frames and stacked and nested one within the other for shipment.

An alternative embodiment of the present invention is illustrated in FIG. 4. In this embodiment, the optional end wires 25 have been removed and replaced with continuous longitudinal wires 31. These longitudinal wires 31 have their ends crimped around the border wire ends 12. These end wires 31 may be welded along their lengths to the upper connector wires 19 as desired. In this embodiment, the lower connector wires 22 of the first embodiment of FIGS. 1–3 have been eliminated. This facilitates stacking of the assemblies as illustrated in FIG. 6. In this embodiment, the upper connector wires 19 are welded intermediate of their ends along their lengths to the underneath sides of the flattened peaks 17 of the support wires 13. This allows the longitudinal wires 31 to rest atop and be generally coplanar with the flattened peaks 17 of the support wires 13 when the assemblies are stacked as illustrated in FIG. 6.

Figure 8:
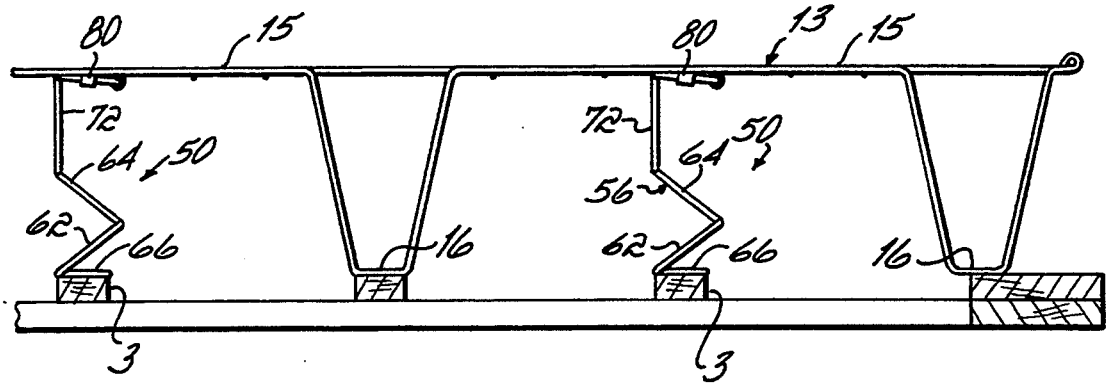
FIG. 8 is a view taken along lines 8—8 of FIG. 7.
Figure 7:
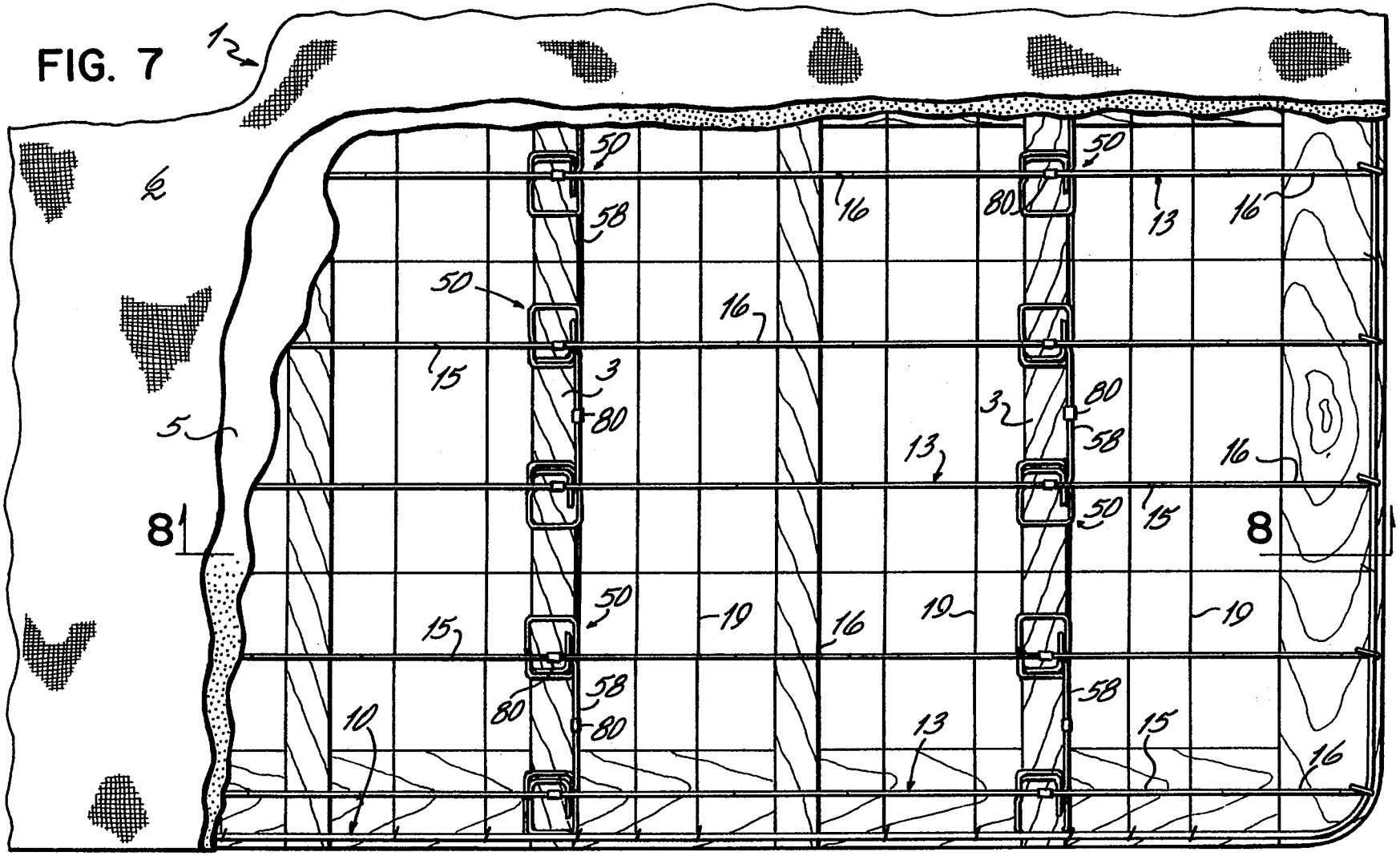
FIG. 7 is a top plan view, partially broken away, of a quarter of a bedding foundation assembly including the present invention with springs disposed between and connected to the nestably stackable assembly and the base.
Figure 9:
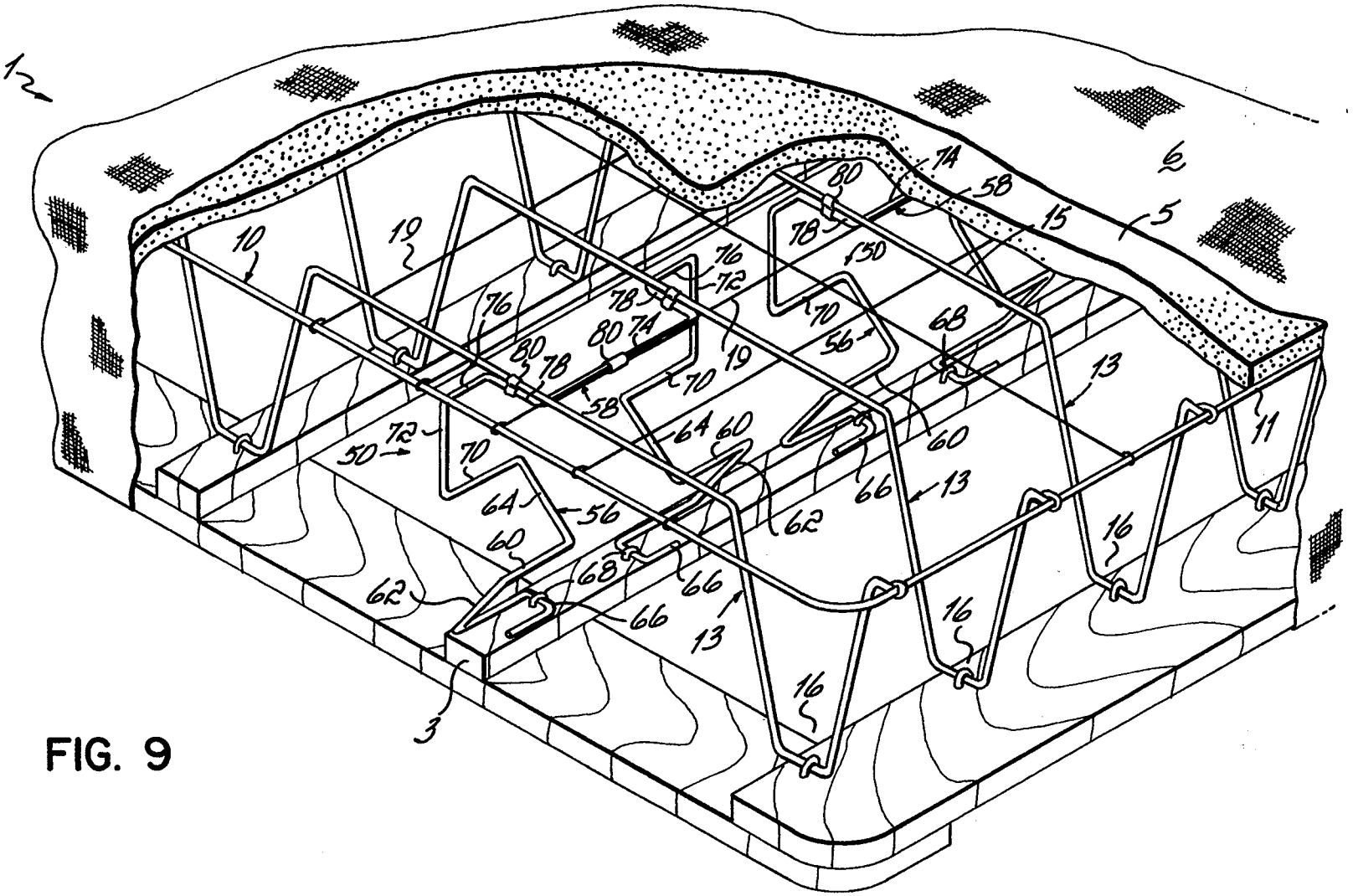
FIG. 9 is a perspective view of the bedding foundation assembly of FIG. 7.

With reference to FIGS. 7, 8 and 9, and with like numbers representing like components, there is illustrated a bedding foundation 1 and further including modular springs 50 incorporated therein. These modular springs 50 are fully described in U.S. Pat. No. 4,000,531 to Inman, issued Jan. 4, 1977 and assigned to the assignee of the present invention. The disclosure of Inman U.S. Pat. No. 4,000,531 is hereby incorporated fully by reference.

As can be seen, each spring 50 includes a pair of fish mouth sections 56 extending upwardly from the wooden slats 3 and a connecting section 58 that interconnects the fish mouth sections. Each fish mouth section 56 includes a torsion bar 60 whose opposite ends are connected to downwardly and upwardly inclined spacer bars 62 and 64. The lower ends of the downwardly extending spacer bars 62 are integrally joined with J-shaped attaching sections 66 of the springs which are secured by staples 68 to the associated wooden slats 3. The upper ends of the upwardly extending spacer bars 64 are integrally joined with torsion bars 70 that are also integrally connected with height spacer bars 72. An inboard main section 74 of the spring connecting section 58 is connected to outboard end portions 76 of the connecting section by outwardly extending wire legs 78.

As can be seen more particularly in FIG. 9, the connecting sections 58 are secured to the transversely spaced, parallel, and longitudinally extending steel support wires 13 with sheet metal clips 80. Similarly, the inboard main portion 74 of these spring connecting sections 58 are secured to the longitudinally spaced, parallel, and transversely extending steel upper connector wires 19 with sheet metal clips 80. The springs 50 resiliently support the support wires 13 intermediate of the peaks 15, thereby bridging the gap between the valleys 16 to provide support along the entire length of the assembly.

While we have described only two embodiments of our invention, those persons skilled in the art will readily recognize modifications and changes which may be made without departing from the spirit or scope of the invention. Specifically, those persons will readily appreciate that springs of differing configurations from that of the springs 50 may be utilized in the practice of this invention. Accordingly, we intend for our invention to be limited only by the following claims.

What is claimed is:

1. A bedding foundation comprising:

a rectangular base, a nestably stackable wire core assembly fixedly attached atop said base, and spring means disposed between and connected to said base and said nestably stackable assembly;

said nestably stackable assembly comprising:

a rectangular border wire having two parallel sides and two parallel ends, transversely-spaced, parallel, and longitudinally-extending support wires parallel to said border wire sides and having ends connected to said border wire ends, said support wires being formed so as to be generally corrugated along their lengths, said corrugatedly formed support wires having peaks and valleys, said peaks being flattened at their tops, said flattened peaks being generally coplanar with a plane defined by said border wire, said valleys being vertically displaced beneath and intermediate of said flattened peaks, and longitudinally-spaced, parallel, and transversely-extending upper connector wires parallel to said border wire ends and having ends connected to said border wire sides, said upper connector wires being connected intermediate of their ends along their lengths to said flattened peaks of said support wires.

2. The bedding foundation of claim 1 wherein longitudinal voids between said flattened peaks of said nestably stackable assembly are of a dimension greater than said valleys of said nestably stackable assembly.

3. The bedding foundation of claim 2 wherein said nestably stackable assembly is a first assembly, which, when placed atop a second assembly of like construction, is nestably stacked thereon when said valleys of said first assembly enter into said voids between said flattened peaks of said second assembly, said nested assemblies having a total heighth dimension less than a sum of a heighth dimension of said first assembly and a heighth dimension of said second assembly.

4. The bedding foundation of claim 1 further including:

a foam pad overlying said nestably stackable assembly, and a fabric covering overlying said pad and surrounding said nestable assembly and base.

5. A bedding foundation comprising:

a rectangular base, a nestably stackable wire core assembly fixedly attached atop said base, and spring means disposed between and connected to said base and said nestably stackable assembly;

said nestably stackable assembly comprising:

a rectangular border wire having two parallel sides and two parallel ends, transversely-spaced, parallel, and longitudinally-extending support wires parallel to said border wire sides and having ends connected to said border wire ends, said support wires being formed so as to be generally corrugated along their lengths, said corrugatedly formed support wires having peaks and valleys, said peaks being flattened at their tops, said flattened peaks being generally coplanar with a plane defined by said border wire, said valleys being vertically displaced beneath and intermediate of said flattened peaks, longitudinally-spaced, parallel, and transversely-extending upper connector wires parallel to said border wire ends and having ends connected to said border wire sides, said upper connector wires being connected intermediate of their ends along their lengths to said flattened peaks of said support wires; and longitudinally-spaced, parallel, and transversely-extending lower connector wires parallel to said border wire ends and having ends connected to said valleys of said outboardmost support wires, said lower connector wires being connected intermediate of their ends along their lengths to said valleys of said support wires between said outboardmost support wires.

6. The bedding foundation of claim 5 wherein longitudinal voids between said flattened peaks of said nestably stackable assembly are of a dimension greater than said valleys of said nestably stackable assembly.

7. The bedding foundation of claim 6 wherein said nestably stackable assembly is a first assembly, which, when placed atop a second assembly of like construction, is nestably stacked thereon when said valleys of said first assembly enter into said voids between said flattened peaks of said second assembly, said nested assemblies having a total heighth dimension less than a sum of a heighth dimension of said first assembly and a heighth dimension of said second assembly.

8. The bedding foundation of claim 5 further including:

a foam pad overlying said nestably stackable assembly, and a fabric covering overlying said pad and surrounding said nestable assembly and base.

* * * * *